United States Patent [19]

Koetter

[11] 4,265,351

[45] May 5, 1981

[54] APPARATUS FOR TOTALIZING SALES

[75] Inventor: Robert E. Koetter, St. Charles, Mo.

[73] Assignee: UMC Industries, Inc., Stamford, Conn.

[21] Appl. No.: 81,002

[22] Filed: Oct. 1, 1979

[51] Int. Cl.[3] ..... G07F 9/00

[52] U.S. Cl. ..... 194/1 M; 194/2; 235/92 AC

[58] Field of Search ..... 194/1 R, 1 L, 1 M, 2, 194/10; 235/92 AC, 92 CN, 92 K, 92 ST

[56] References Cited

U.S. PATENT DOCUMENTS

| | | | |
|---|---|---|---|
| 2,780,337 | 2/1957 | Fremon | 194/1 M X |
| 3,335,838 | 8/1967 | Schuller et al. | 194/10 |
| 3,494,454 | 2/1970 | Calgaro et al. | 194/1 R |
| 4,143,749 | 3/1979 | Otten | 194/1 N |

FOREIGN PATENT DOCUMENTS

| | | | |
|---|---|---|---|
| 2730587 | 1/1978 | Fed. Rep. of Germany | 194/1 M |

*Primary Examiner*—Joseph J. Rolla

*Attorney, Agent, or Firm*—Senniger, Powers, Leavitt and Roedel

[57] ABSTRACT

Apparatus for totalizing sales of a vendor, the vendor having a plurality of selection circuits adapted to be energized for vending items at different prices which are whole multiples of 5¢, the apparatus comprising an electrically operated register operable on being electrically pulsed to register a 5¢ increment, and a system operable on energization of a selection circuit to vend an item for pulsing the register a number of times equal to one-fifth the price of the item, thereby stepping up the register the number of 5¢ increments corresponding to the price of the selected item.

12 Claims, 5 Drawing Figures

APPARATUS FOR TOTALIZING SALES

BACKGROUND OF THE INVENTION

This invention relates to apparatus for totalizing sales of items vended at different prices, and more particularly to apparatus for totalizing the sales of a vending machine (a vendor).

The invention is especially concerned with apparatus for totalizing the sales of a vendor having a plurality of selection circuits for vending items at different prices in the series of values 5¢, 10¢, 15¢, 20¢, 25¢, etc. (e.g., 50¢, 75¢, $1.00), each circuit being energized upon establishment of credit in the vendor at least equal to the price of a desired item and actuation of a respective selection means (e.g., a selection switch) for completing the respective selection circuit.

There are many electrically operated vendors on location, and it is anticipated that many electrically operated vendors will be supplied to vending machine operators, which utilize an electrical coin handling device of the type disclosed in the coassigned Schuller et al. U.S. Pat. No. 3,335,838 adapted to accept nickels, dimes and quarters and to control the vending of items at prices in the series of values 5¢, 10¢, 15¢, 20¢, 25¢, etc. (which series comprises whole multiples of 5¢, and which may be referred to as the 5¢ series). The device shown in said U.S. Pat. No. 3,335,838 controls the energization of selection circuits for vending items at different prices, such as the circuits indicated at L6-L10 in said patent, each such circuit being energized upon establishment of credit in the vendor in which the device is used at least equal to the respective price, and actuation of a respective selection means (e.g., a selection switch) for completing the circuit. These coin-handling devices, which may handle change-making functions as disclosed in U.S. Pat. No. 3,335,838 or which may operate on an exact change basis without any change function, totalize only the amount of coin deposited on each vend; it has not been feasible to utilize them directly for totalizing sales for various reasons including their relatively high reset speed, which is generally too fast for directly actuating suitable registers.

SUMMARY OF THE INVENTION

Accordingly, among the several objects of this invention may be noted the provision of apparatus for totalizing the sales of a vendor, for use in conjunction with a vendor having selection circuits for vending at different prices, and particularly a vendor having a coin handling device of the type such as shown in said U.S. Pat. No. 3,335,838; and the provision of such apparatus which is well adapted for use in conjunction with a fast resetting coin handling device.

In general, apparatus of this invention for totalizing the sales of a vendor operates in response to energization of selection circuits of the vendor for vending items at different prices in the series of values 5¢, 10¢, 15¢, 20¢, 25¢, etc., each such circuit being energized upon establishment of credit in the vendor at least equal to the respective price and actuation of a selection means for completing the circuit. The apparatus comprises an electrically actuated register operable on being electrically pulsed to register a 5¢ increment, a switch comprising a series of fixed contacts spaced at intervals and representing amounts in said series of values in sequence at least up to the highest price, and a contact movable through a cycle from a home position successively into engagement with the fixed contacts in reverse direction so as to engage the fixed contact representing the highest amount and then to engage in succession the fixed contacts representing the successively lower amounts and then to return to home position, and means operable in response to energization of any of said selection circuits for operating said movable contact through a cycle. Control means operable in response to energization of any of said selection circuits energizes the fixed contacts when the movable contact, moving through said cycle in said reverse direction, engages the fixed contact representing the amount corresponding to the price of the selected item under control of that selection circuit. The fixed contacts are connected in a circuit with the register whereby, as the movable contact engages the fixed contact representing the price of the selected item, and then successively engages the remainder of the fixed contacts and returns to the home position, the register is pulsed a number of times equal to one-fifth the price of the selected item, to step up the register a number of 5¢ increments corresponding to that price.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
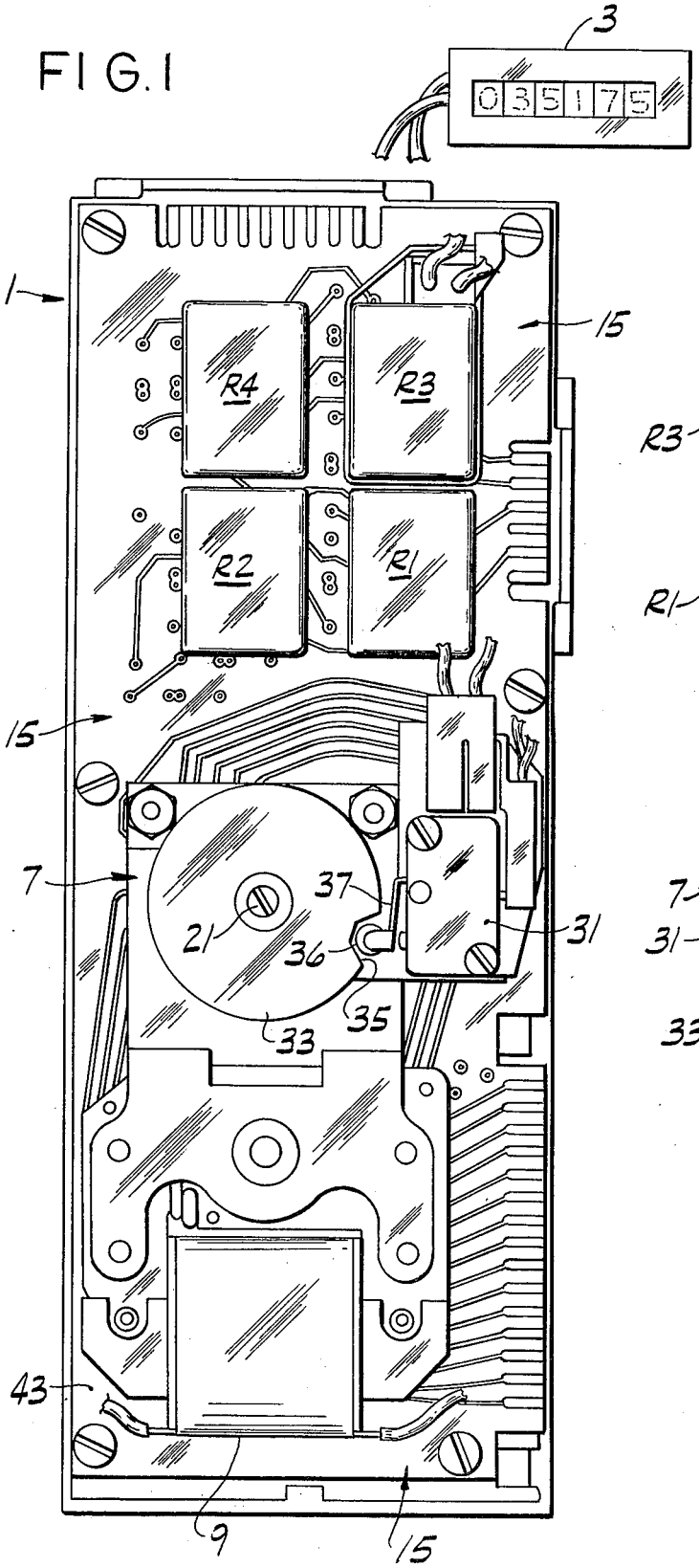
FIG. 1 is a front elevation of a sales totalizing apparatus of this invention.

Referring to the drawings, there is generally indicated at 1 apparatus of this invention for totalizing the sales of a vendor (a vending machine), the vendor being of a well-known type having a plurality of selection circuits operable for vending items at different prices in the series of values 5¢, 10¢,. 15¢, 20¢, 25¢, etc. In this type of vendor, each selection circuit is energized upon establishment of credit by deposit of coin in the vendor in an amount at least equal to the respective price, i.e., the price of the item to be vended upon energization of that selection circuit, and actuation of a respective selection means (e.g., a selection switch) for completing the circuit. Reference may be made to the aforesaid coassigned Schuller et al. U.S. Pat. No. 3,335,838 for a disclosure of a coin handling and change making device for controlling the operation of such a vendor for vending items at different prices in the series of values 5¢, 10¢, 15¢, 20¢, 25¢, etc., which may be referred to as the 5¢ series (whole multiples of 5¢), and for making change in accordance with the amount deposited in the vendor and the price of an item selected by the purchaser. Typical selection (vend) circuits are indicated at L6-L10 in this patent. The apparatus 1 comprises an electrically actuated register 3 which is operable on being electrically pulsed to register a 5¢ increment, and is responsive on energization of any selection circuit for the vending of an item at a price in the 5¢ series to pulse the register a number of times equal to one-fifth the price of the item, thereby causing the register to add that amount to the previous amount registered.

The apparatus 1 comprises a switch A having a series of fixed contacts spaced at intervals and representing amounts in the said 5¢ series up to an amount at least equal to the highest price of an item to be vended (e.g., $1.50) and a movable contact 5 engageable with the fixed contacts. The fixed contacts are designated A5, A10, A15 . . . A150 representing the amounts 5¢, 10¢, 15¢ etc. up to $1.50. The contact 5 is movable through a cycle from a home position (FIGS. 4 and 5) wherein it is between contacts A5 and A150 successively into engagement with the fixed contacts and back to home position, with the contact 5 moving in reverse direction (counterclockwise as viewed in FIGS. 4 and 5) with respect to the series of fixed contacts so as first to engage the fixed contact representing the highest amount (e.g., contact A150) and then to engage in succession the fixed contacts representing the successively lower amounts (A145, A140, etc.) and then to return to the home position.

Means indicated generally at 7 and comprising an electric motor 9 is provided operable in response to energization of the selection circuits of the vendor in association with which the totalizer apparatus 1 is used for operating the movable contact 5 through its cycle.

Control means indicated generally at 11 (FIG. 5) operates in response to energization of a selection circuit for energizing the fixed contacts of switch A when the movable contact 5 of switch A, moving through its cycle in said reverse direction over the fixed contacts A150–A5, engages the fixed contact representing the amount corresponding to the price of the selected item under control of that selection circuit. For example, if a selection circuit for vending a $1.00 item is energized, the control means 11 operates when the contact 5 engages contact A100 to energize the fixed contacts. And the fixed contacts A5–A150 are all connected as indicated at 13 in FIG. 5 in a circuit with the register 3 whereby, as the movable contact engages the stated fixed contact representing the amount corresponding to the price of the selected item vended (e.g., contact A100 representing the price of $1.00) and then successively wipes over the remainder of the fixed contacts (A95, A90 . . . A5) back to the home position, the register 3 is pulsed a number of times equal to one-fifth the price of the selected item to step up the register a number of 5¢ increments corresponding to the price of the selected item.

Figure 4:
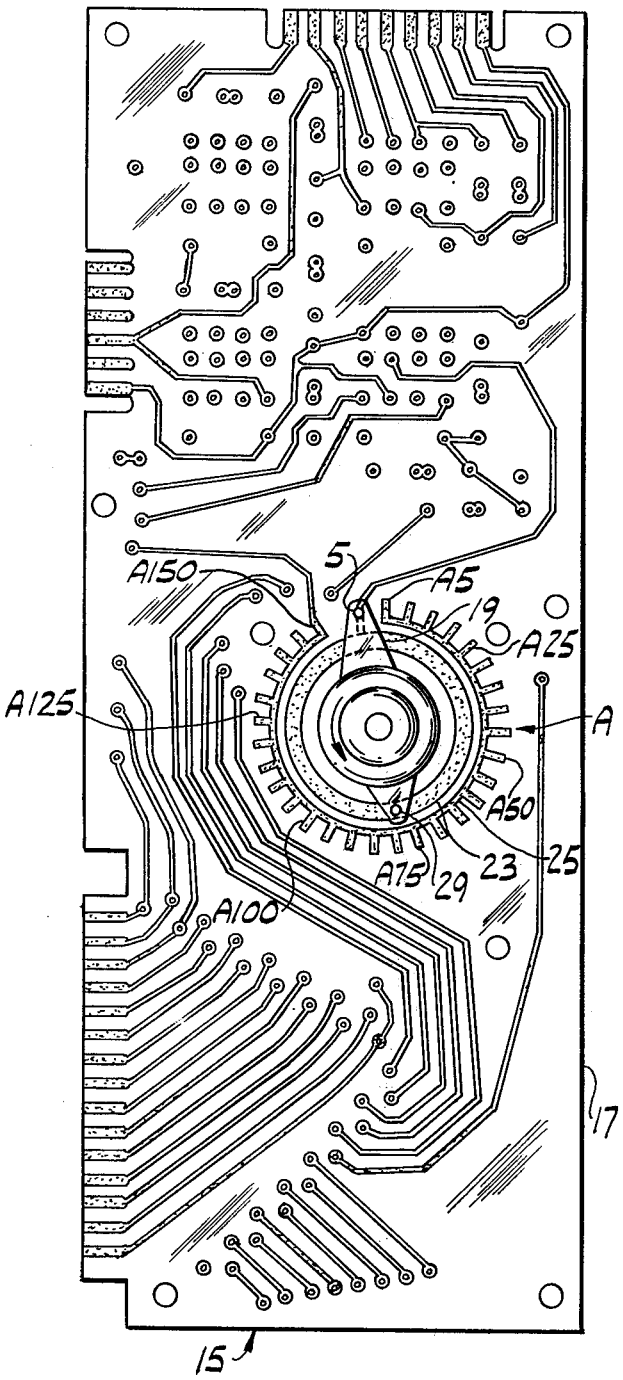
Figure 5:
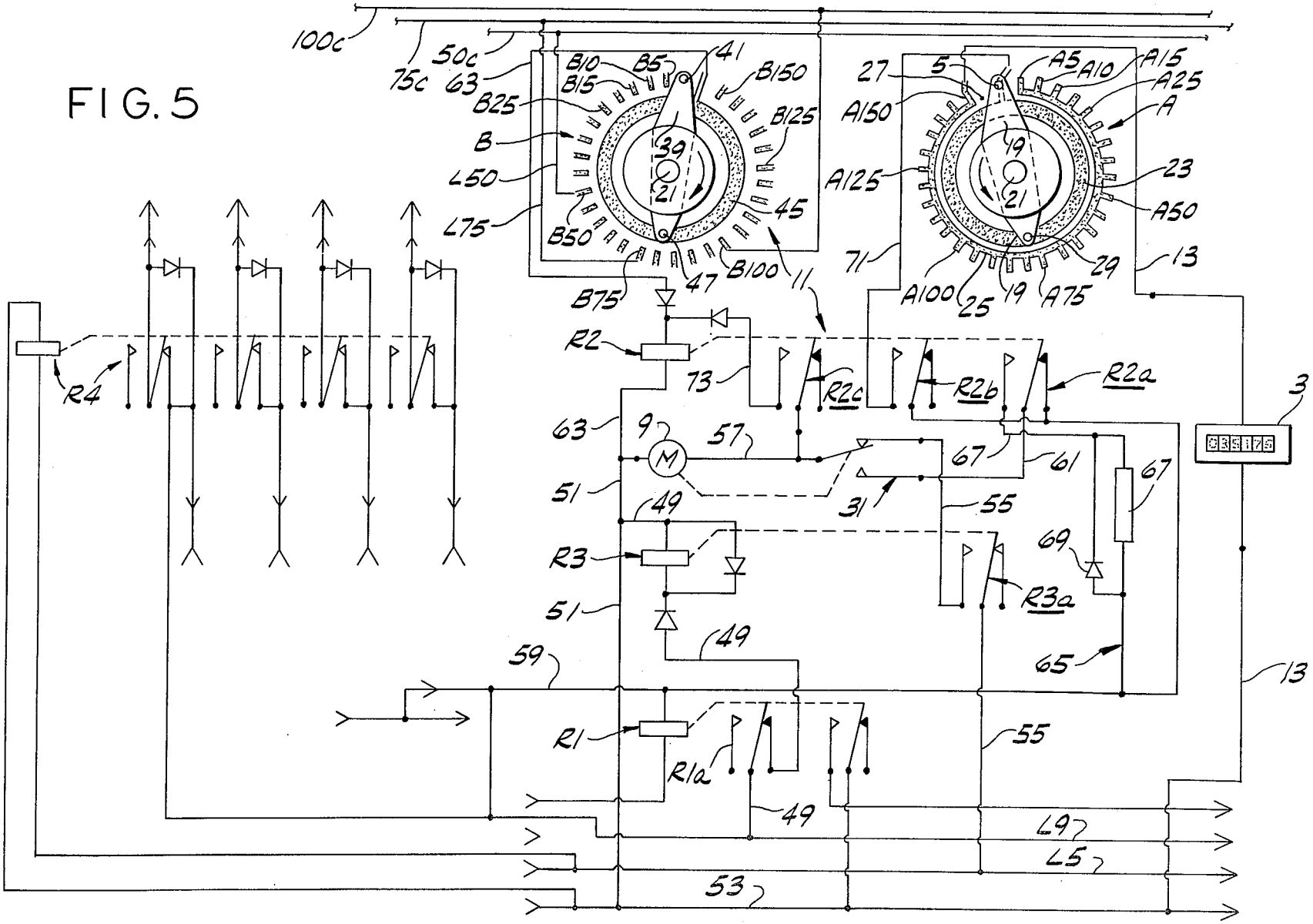
FIG. 5 is a wiring diagram.

In greater particularity, the apparatus 1 comprises a printed circuit board 15, the contacts A5–A150 of the switch A being printed on one face 17 of this board which may be referred to as its back face. The switch A is a rotary switch, the movable contact 5 of the switch being on an electrically conductive switch arm or rotor 19 on a shaft 21 rotatable on an axis perpendicular to the board 15, the shaft extending through a hole in the board. An electrically conductive contact ring 23 is printed on the board centered in the axis of the shaft 21. The fixed contacts A5 etc. are printed on the board arranged on a circle surrounding ring 23 (and surrounding said axis), being spaced at intervals around this circle and extending radially outward from an electrically conductive interrupted circle 25 provided on the board electrically interconnecting all of the contacts, with a gap at 27 in circle 25 between contacts A5 and A150. The rotor contact 5 is at one end of the rotor 19 radially outward of the interrupted circle 25. Rotor 19 also carries a second contact 29 engaging the ring 23 (continuously to electrically interconnect the rotor and the ring). The arrangement is such that rotor 19 is rotatable through a single-revolution cycle in counterclockwise direction as viewed in FIGS. 4 and 5 from its home position in which it is shown in FIGS. 4 and 5 to cause contact 5 to wipe successively over the fixed contacts A150–A5 in that order and then return to its home position of FIGS. 4 and 5.

Figure 2:
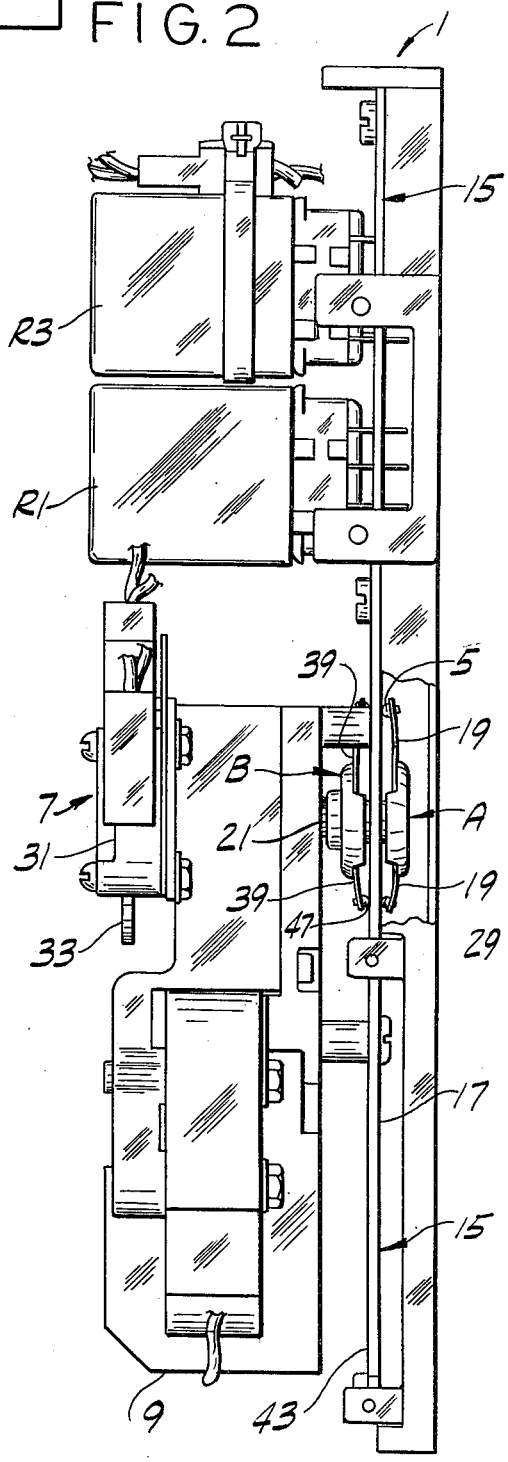
FIG. 2 is a side elevation of the apparatus.

The electric motor 9 is mounted on the front of the printed circuit board and drives the switch shaft 21 via suitable speed reduction gearing incorporated in the motor. Means 7 for operating the rotor 19 carrying contact 5 through a single-revolution cycle from the home position (FIGS. 4 and 5), comprises a holding circuit for the motor including a holding switch 31 (see FIGS. 1, 2 and 5) and a cam 33 on shaft 21 rotatable with the rotor 19 (on the axis of the rotor) controlling the holding switch, the arrangement being such that the cam actuates the switch to establish the holding circuit when the motor starts on energization of a selection circuit and deactuates it when the cam and switch member have completed a revolution. For this purpose the cam has a notch 35, the holding switch having a roller 36 on the end of its operating arm 37 which drops into the notch at the end of the single-revolution cycle of the cam.

The control means 11 comprises a second rotary switch B having a second series of fixed contacts spaced at intervals around a second circle and representing amounts in the 5¢ series up to an amount at least equal to the highest price of an item to be vended (e.g., $1.50) and a second rotary switch member or rotor 39 rotatable on the axis of the stated second circle and having a rotor contact 41 engageable with the fixed contacts. The latter are designated B5, B10, B15 . . . B150 representing 5¢, 10¢, 15¢ . . . $1.50. The rotor 39 is movable in a single-revolution cycle from a home position wherein contact 41 is between fixed contacts B5 and B150 successively into engagement with the fixed contacts of switch B back to home position with the rotor contact 41 moving in reverse direction with respect to the series of fixed contacts so as first to engage the fixed contact representing the highest amount (e.g. B150 representing $1.50) and then to engage in succession the fixed contacts representing the successively lower amounts until the rotor contact 41 returns to the home position.

Figure 3:
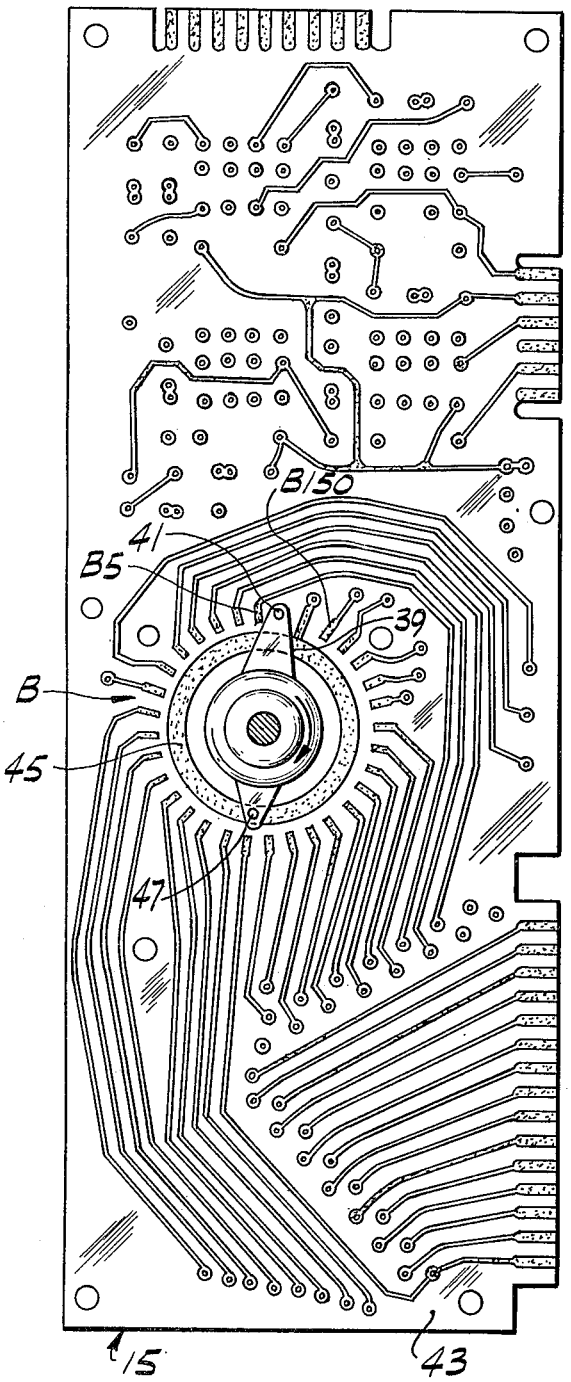
FIGS. 3 and 4 are sections on lines 3—3 and 4—4 of FIG. 2 showing the front and back of a printed circuit board of the apparatus.

Contacts B5–B150 are printed on the front face 43 of the printed circuit board 15, arranged on a circle surrounding and concentric with the shaft 21 and an electrically conductive contact ring 45 printed on the front face of the board. The switch comprises rotor 39 constituted by an electrically conductive arm on shaft 21, the rotor contact 41 being at one end of this arm on the radius of the circle of contacts B5 etc. In the home position of rotor arm 39, the rotor contact 41 is between contacts B5 and B150. Arm 39 also carries a rotor contact 47 engaging the ring 45 continuously to electrically interconnect the arm 39 and ring 45. The arrangement is such that the rotor arm 39 is rotated through a single-revolution cycle along with arm 19 in clockwise direction as viewed in FIGS. 3 and 5 from the front of the board from its home position (in which it is shown in FIGS. 3 and 5) to cause rotor contact 41 to wipe successively over the fixed contacts B150–B5 (in that order) and then return to home position.

Now referring to FIG. 5, selection circuits 50C, 75C and 100C of a vendor are illustrated, these being completed for the vending of items selling at 50¢, 75¢ and $1.00, respectively, upon the deposit of coin in amount at least equal to the price of the selected item and actuation of the respective selection switch. These selection circuits are connected as indicated at L50, L75 and L100 to the respective contacts of the switch B, i.e., 50C is connected by L50 to contact B50 (the 50¢ contact), 75C is connected by L75 to B75 (the 75¢ contact) and 100C is connected by L100 to B100 (the $1.00 contact). These three selection circuits (and prices) are only by way of example; selection circuits for other prices in the 5¢ series would be connected to the fixed contacts of switch B corresponding to those prices. Also illustrated are lines designated L5 and L9 which are interconnected in the vendor with the selection circuits to be energized when any selection circuit is energized. Line L5 corresponds to the line indicated at L14 in the aforesaid U.S. Pat. No. 3,335,838 including the reset motor 179 which is energized on initiation of a vending operation to reset the coin handling mechanism.

On energization of any of the selection circuits 50C, 75C, 100C to effect a vend, with accompanying energization of lines L5 and L9, a relay R3 is energized from line L9 via a circuit 49 including the normally closed contacts **R1*a* of a relay R1 and a line 51 to the low side of the circuit at 53. When relay R3 is energized, its contacts R3*a* close and complete a circuit 55 for the motor 9 from line L5 to the upper contact (as shown in FIG. 5) of the holding switch 31 and the movable member of switch 31, which is normally closed on the upper contact, and a line 57 to line 51. This starts the motor 9 to operate the switches A and B and to rotate the cam 33. As the cam rotates, it actuates the holding switch 31 to throw its movable member down on its lower contact and this establishes a holding circuit for the motor from line L9 via a line 59 to the right-hand contact (as viewed in FIG. 5) of a set of contacts R2*a* of a relay R2, thence via the movable member of this set which is normally closed on the right-hand contact of the set and a line 61 to the lower contact of the switch 31**.

Thus, the motor 9 is set in operation to drive the switch rotors 19 and 39 through their single-revolution cycle. Assuming that selection circuit 50C for vending a 50¢ item has been energized, contact B50 will be energized. When the rotor contact 41 of switch B engages contact B50, a circuit is completed through the coil of relay R2 to energize it from contact B50, rotor 39 of switch B, conductive ring 45 and a line 63 to line 51 and the low side 53 of the circuit. Up to this point, the motor has been operating at relatively high speed to drive the rotors at relatively high speed. However, on the energization of relay R2, the movable member of its set of contacts **R2*a* is thrown over to the left-hand contact of the set to energize the motor 9 via a slow-down circuit 65 including a resistor 67 and a diode 69 around the resistor, thereby to slow down the motor for the remainder of the single-revolution cycle of the rotors 19 and 39. At the same time, a set of contacts R2*b* of relay R2 is closed to complete a circuit 71 from line 59 to the ring 23 of switch A. Also, a set of contacts R2*c* of relay R2 is closed to complete a holding circuit 73 for the coil of relay R2**.

Now, with ring 23 of switch A energized, as the rotor contact 5 of this switch rotates through the remainder of its single-revolution cycle and wipes over contact A50 and then over contacts A45–A5 back to the home position, it causes ten pulses to be delivered to the register 3, ten pulses being one-fifth the price (50¢) of the selected item. This steps up the register ten 5¢ increments, corresponding to that price (50¢), and thus the 50¢ sale is registered to totalize the sales of the vendor.

Assuming that selection circuit 75C for vending a 75¢ item has been energized, contact B75 is energized. The motor 9 is operated at the relatively high speed until contact 41 engages contact B75. At this point, relay R2 is energized to slow down the motor and energize ring 23. Then, as rotor contact 5 of switch A wipes over contacts A75–A5 and back to home position, it causes fifteen pulses (one fifth of the 75¢ price) to be delivered to the register 3, stepping the latter up fifteen 5¢ increments (equalling 75¢).

Assuming that selection circuit 100C for vending a $1.00 item has been energized, contact B100 is energized. The motor 9 is operated at the relatively high speed until contact 41 engages contact B100. At this point, relay R2 is energized to slow down the motor and energize ring 23. Then as rotor contact 5 of switch A wipes over contacts A100–A5 and back to home position, it causes twenty pulses (one fifth of the $1.00 price) to be delivered to the register 3, stepping the latter up twenty 5¢ increments (equalling $1.00).

Relay R1 is controlled by a switch (not shown) in the coin-handling mechanism, being energized to open contacts **R1*a* thereby breaking the motor-starting circuit when the coin-handling mechanism is cycled. This avoids the possibility of motor 9** starting on a second cycle.

At R4 is indicated a relay which is used in conjunction with one particular vendor only (a cigarette vendor) sold by the assignee for shorting out certain diodes in change payment circuitry. This is not critical insofar as the present invention is concerned, and hence will not be described in detail.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for totalizing the sales of a vendor in response to energization of selection circuits of the vendor for vending items at different prices in the series of values 5¢, 10¢, 15¢, 20¢, 25¢, etc., each circuit being energized upon establishment of credit in the vendor at least equal to the respective price and actuation of a selection means for completing the circuit, said apparatus comprising:

an electrically actuated register operable on being electrically pulsed to register a 5¢ increment;

a switch comprising a series of fixed contacts spaced at intervals and representing amounts in said series of values in sequence at least up to the highest price, and a contact movable through a cycle from a home position successively into engagement with the fixed contacts in reverse direction so as to engage the fixed contact representing the highest amount and then to engage in succession the fixed contacts representing the successively lower amounts and then to return to home position;

means operable in response to energization of any of said selection circuits for operating said movable contact through a cycle;

control means operable in response to energization of any of said selection circuits for energizing the fixed contacts when the movable contact, moving through said cycle in said reverse direction, engages the fixed contact representing the amount corresponding to the price of the selected item under control of that selection circuit;

said fixed contacts being connected in a circuit with said register whereby, as the movable contact engages the fixed contact representing the price of the selected item, and then successively engages the remainder of the fixed contacts and returns to the home position, the register is pulsed a number of times equal to one-fifth the price of the selected item, to step up the register a number of 5¢ increments corresponding to that price.

2. Apparatus as set forth in claim 1 wherein the means for operating the movable contact through a cycle is operable to drive it at a relatively high speed until it engages the said fixed contact representing the amount of the price of the selected item and then to drive it at relatively slow speed from that point back to the home position.

3. Apparatus as set forth in claim 1 wherein said switch is a rotary switch, said movable contact being on a rotor and said fixed contacts being arranged on a circle around the axis of the rotor, spaced at intervals around the circle.

4. Apparatus as set forth in claim 3 wherein said means for operating the movable contact through a cycle comprises an electric motor, and means operable in response to energization of any of said selection circuits for operating the motor to drive the rotor carrying the movable contact through a single-revolution cycle to rotate said movable contact around in a circle from the home position successively over the fixed contacts in reverse direction and back to the home position.

5. Apparatus as set forth in claim 4 wherein said motor operating means comprises circuitry for starting the motor in response to energization of any selection circuit and means comprising a holding switch operable by a cam rotatable with the rotor for holding the motor in operation for a single revolution of the cam and the rotor.

6. Apparatus as set forth in claim 4 having means for operating the motor at a relatively high speed until the movable contact engages the said fixed contact representing the price of the selected item and then operating it at a relatively low speed for the remainder of the single-revolution cycle of said rotor.

7. Apparatus as set forth in claim 4 wherein said control means comprises a second rotary switch having a series of fixed contacts spaced around a second circle and representing amounts in said series of values 5¢, 10¢, 15¢, 20¢, 25¢, etc. in sequence up to the highest price, and a rotor rotatable on the axis of said second circle and carrying a contact engageable with said fixed contacts of the second switch, said second switch rotor being rotatable with the first switch rotor in a single-revolution cycle from a home position successively into engagement with said fixed contacts of the second switch in reverse direction and back to home position, certain of said fixed contacts of said second switch being energized on energization of respective selection circuits of the vendor, and means operable on energization of one of said selection-circuit-energized contacts of said second switch for energizing the fixed contacts of the first switch.

8. Apparatus as set forth in claim 7 having means for operating the motor at a relatively high speed until the said one of the said selection-circuit-energized contacts of the second switch is energized and then operating the motor at a relatively low speed for the remainder of the single-revolution cycle of the rotors.

9. Apparatus as set forth in claim 8 wherein the means for energizing the fixed contacts of the first switch and the means for operating the motor at the high and low speeds comprises a relay energized on energization of said one of the selection-circuit-energized contacts of the second switch, a first set of relay contacts for energizing the fixed contacts of the first switch, and a second set of relay contacts for switching from the high speed to the low speed operation of the motor.

10. Apparatus as set forth in claim 9 wherein the last-named relay contacts switch a resistor and a diode into the motor circuit for slowing down the motor.

11. Apparatus as set forth in claim 9 having a printed circuit board, the fixed contacts of the first switch being printed on one face of the board, the fixed contacts of the second being printed on the other face of the board, the rotors being on the respective faces of the board on a shaft driven by the motor extending through a hole in the board.

12. Apparatus as set forth in claim 11 wherein the fixed contacts of the first switch extend generally radially from an electrically conductive interrupted ring on the one face of the board, the said rotor contact of the first switch being on the radius of said fixed contact circle of the first switch, and the rotor of the first switch having a second contact engaging said ring, the second switch having an electrically conductive ring printed on the said other face of the board and the second rotor having a contact engaging the latter ring, the ring of the second switch being connected to the relay, and the first set of relay contacts being connected to the ring of the first switch.

* * * * *